US011280503B2

(12) United States Patent
Alvarez Cavazos et al.

(10) Patent No.: US 11,280,503 B2
(45) Date of Patent: Mar. 22, 2022

(54) AIR INTAKE GUARD OF A HEATING, VENTILATION, AND/OR AIR CONDITIONING (HVAC) SYSTEM

(71) Applicant: Johnson Controls Technology Company, Auburn Hills, MI (US)

(72) Inventors: Karla D. Alvarez Cavazos, York, PA (US); Ryan L. Snider, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/592,571

(22) Filed: Oct. 3, 2019

(65) Prior Publication Data

US 2021/0102715 A1 Apr. 8, 2021

(51) Int. Cl.
*F24F 1/58* (2011.01)

(52) U.S. Cl.
CPC ..... *F24F 1/58* (2013.01)

(58) Field of Classification Search
CPC ..... F24F 1/58; F16B 5/0036; F16B 5/126; 1F16B 21/088
See application file for complete search history.

(56) References Cited

U.S. PATENT DOCUMENTS

| | | | | |
|---|---|---|---|---|
| 7,901,278 | B2 | 3/2011 | O'Hagin | |
| 2010/0064895 | A1* | 3/2010 | Thurin | F24F 1/0071 96/222 |
| 2016/0245307 | A1* | 8/2016 | Sauer | F04D 29/601 |
| 2017/0248328 | A1* | 8/2017 | Eskew | F24F 1/22 |
| 2019/0293307 | A1* | 9/2019 | Jones | F24F 1/58 |

FOREIGN PATENT DOCUMENTS

| | | |
|---|---|---|
| CN | 101377323 | 3/2009 |
| CN | 101532587 | 9/2009 |
| CN | 101532719 | 9/2009 |
| CN | 201992267 | 9/2011 |
| CN | 203980488 | 12/2014 |

* cited by examiner

*Primary Examiner* — Schyler S Sanks
(74) *Attorney, Agent, or Firm* — Fletcher Yoder, P.C.

(57) ABSTRACT

An outdoor unit of a heating, ventilation, and/or air conditioning (HVAC) system includes a cabinet defining a cabinet interior of the outdoor unit and separating the cabinet interior from an external environment surrounding the outdoor unit. The outdoor unit also includes an interface between the cabinet interior and the external environment and configured to enable an air flow between the cabinet interior and the external environment. The outdoor unit also includes a plastic guard disposed over the interface.

18 Claims, 9 Drawing Sheets

AIR INTAKE GUARD OF A HEATING, VENTILATION, AND/OR AIR CONDITIONING (HVAC) SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of an air flow delivered to the environment. For example, the HVAC system may draw the air flow into a cabinet from an external environment via an air flow interface, such as an air intake. The HVAC system may pass the air flow over a heat exchanger inside the cabinet to condition the air flow and/or to condition a fluid, such as a refrigerant, passing through the heat exchanger. In some embodiments, other air flow interfaces may be used to route an air flow from the external environment into the cabinet, or from the cabinet into the external environment. In traditional embodiments, the air flow interface(s) may be susceptible to receiving contaminants and other undesirable articles into the cabinet. Further, traditional protective features of the air flow interface may be expensive to manufacture and maintain.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to an outdoor unit of a heating, ventilation, and/or air conditioning (HVAC) system. The outdoor unit includes a cabinet defining a cabinet interior of the outdoor unit and separating the cabinet interior from an external environment surrounding the outdoor unit. The outdoor unit also includes an interface between the cabinet interior and the external environment, where the interface is configured to enable an air flow between the cabinet interior and the external environment. The outdoor unit also includes a plastic guard disposed over the interface The present disclosure also relates to an outdoor unit of a heating, ventilation, and/or air conditioning (HVAC) system. The outdoor unit includes a cabinet defining a cabinet interior of the outdoor unit and separating the cabinet interior from an external environment surrounding the outdoor unit. The outdoor unit also includes an air flow interface between the cabinet interior and the external environment and configured to enable an air flow between the external environment and the cabinet interior. The outdoor unit also includes an opening in the cabinet adjacent to the air flow interface. The outdoor unit also includes a plastic guard disposed over the air flow interface and configured to enable the air flow. The plastic guard includes an integrally formed plastic securement mechanism having a retention mechanism extending through the opening and blocking removal of the integrally formed plastic securement mechanism from the opening.

The present disclosure also relates to a plastic guard of an air flow interface between an external environment and a cabinet interior of a heating, ventilation, and/or air conditioning (HVAC) unit. The plastic guard includes a mesh grid formed by plastic wires and configured to block debris from passing through the air flow interface. The plastic guard also includes a plastic securement mechanism integrally formed with the mesh grid and configured to extend into an opening of a cabinet of the HVAC unit adjacent to the air flow interface of the HVAC unit, and having a retention mechanism configured to enable disposal of the integrally formed plastic securement mechanism through the opening and to block removal of the integrally formed plastic securement mechanism from the opening.

DETAILED DESCRIPTION

Figure 1:
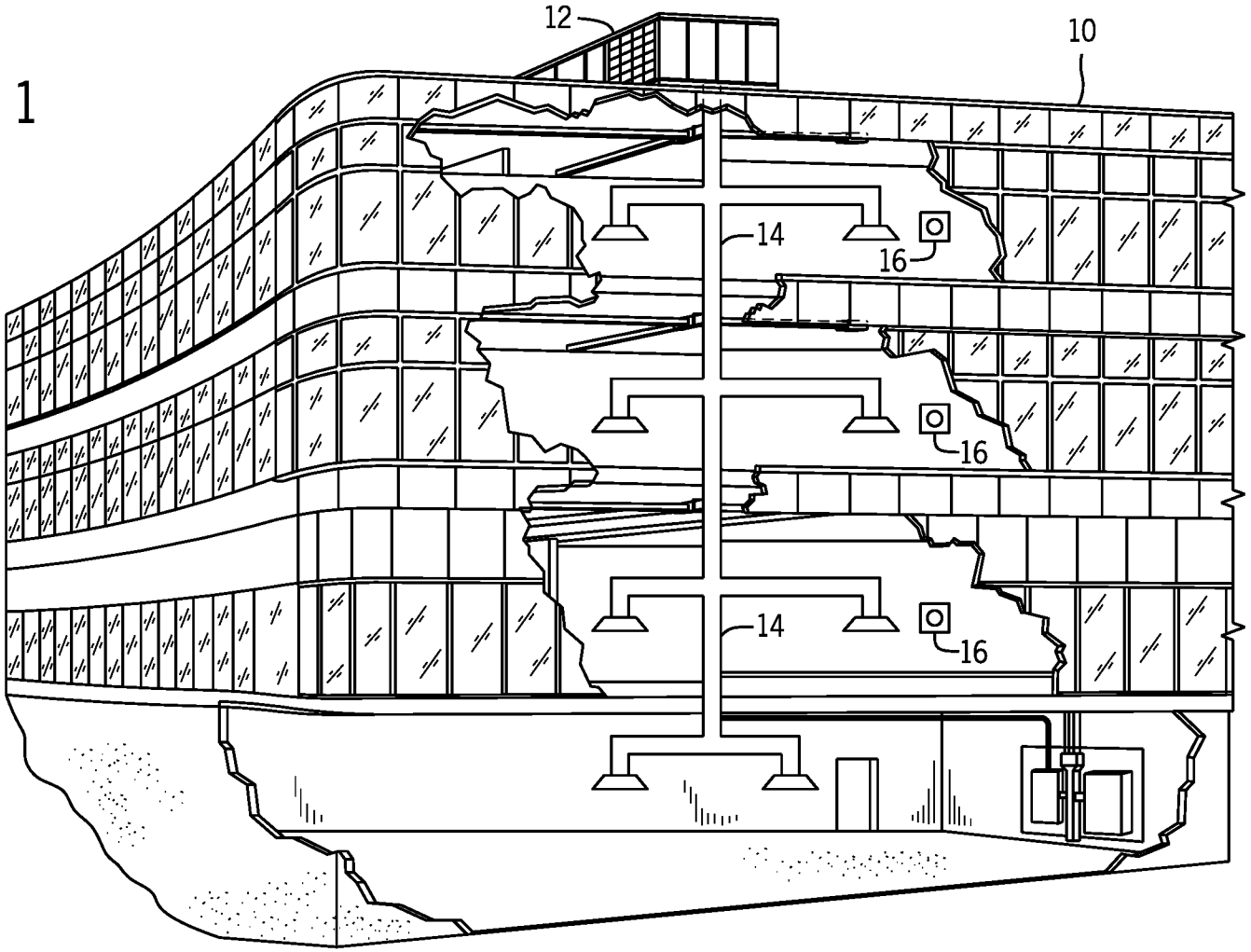
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed toward a heating, ventilation, and/or air conditioning (HVAC) system that includes a cabinet, an air flow interface between an interior of the cabinet and an external environment surrounding the cabinet, and a plastic guard disposed over or around the air flow interface.

An HVAC system may include a cabinet in which components of the HVAC system, such as heat exchangers, a fan, a control box, and others, are disposed. The cabinet may include an air flow interface between an interior of the cabinet and an external environment surrounding the cabinet. The air flow interface may include, for example, a hood, a louver, a fan orifice corresponding to a fan, or an open space or window between frame members forming the cabinet. In traditional embodiments, metal members, such as metal wires, may extend over the air flow interface and block contaminants and other articles in the external environment from passing through the air flow interface and into the interior of the cabinet. The traditional metal members may be welded to the cabinet, which may be expensive and time consuming, or fastened to the cabinet, which may require additional parts. Further, the metal members may be painted or coated with anti-corrosive material, which may be expensive, time consuming, and require maintenance. Further, the metal members may corrode if the anti-corrosive material is not applied and/or wears off over time.

In accordance with present embodiments, a plastic guard may be utilized to protect the air flow interfaces. For example, the plastic guard may be disposed over any air flow interface described in the present disclosure, including an air flow intake, a hood, a louver, a fan orifice, a condenser section wall, a chiller wall, and others. The plastic guard may include an integrally formed plastic securement mechanism configured to engage the cabinet to retain the plastic guard on or in the cabinet. A cabinet opening may be formed in the cabinet and configured to receive the plastic securement mechanism. In some embodiments, the plastic securement mechanism may include a flexible material and certain geometry that, in conjunction with one another, enable the plastic securement mechanism to pass through the cabinet opening in a first direction, and disable removal of the plastic securement mechanism from the cabinet opening in a second direction opposite to the first direction after passing through the cabinet opening. It should also be noted that the plastic guard and integrally formed plastic securement mechanism may be retrofit for existing HVAC systems. For example, the cabinet opening may be punched or otherwise disposed in a wall of a cabinet of an existing HVAC system. In general, the plastic guard may be less expensive than traditional metal members, does not require expensive anti-corrosive coating, is not susceptible to corrosion, and does not require expensive and timely assembly or installation techniques.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12, which may include a cabinet and components disposed within the cabinet. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
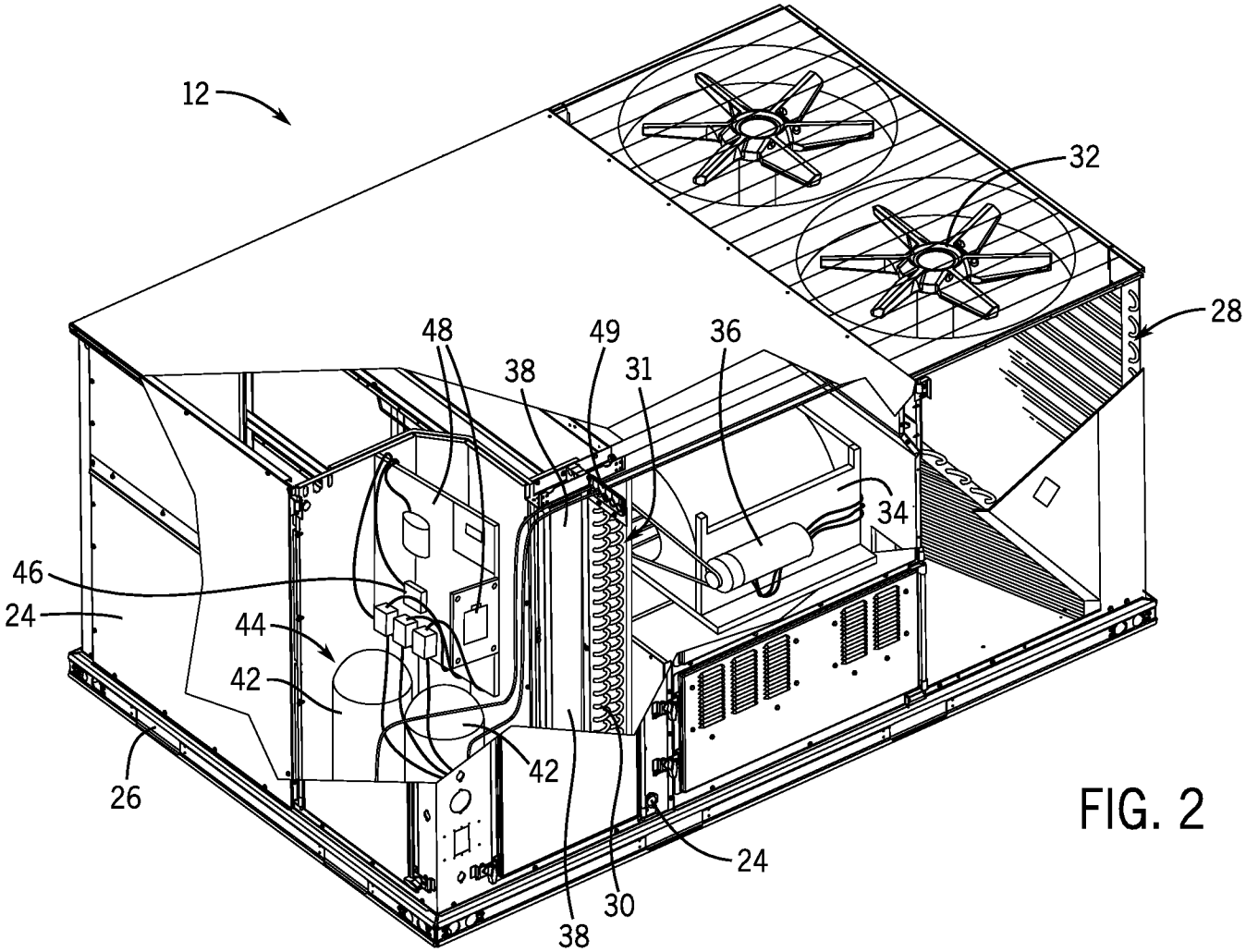
FIG. 2 is a perspective view of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Further, in certain embodiments, the cabinet 24 or a portion thereof may include frame members or beams forming a frame structure that contains HVAC components therein. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
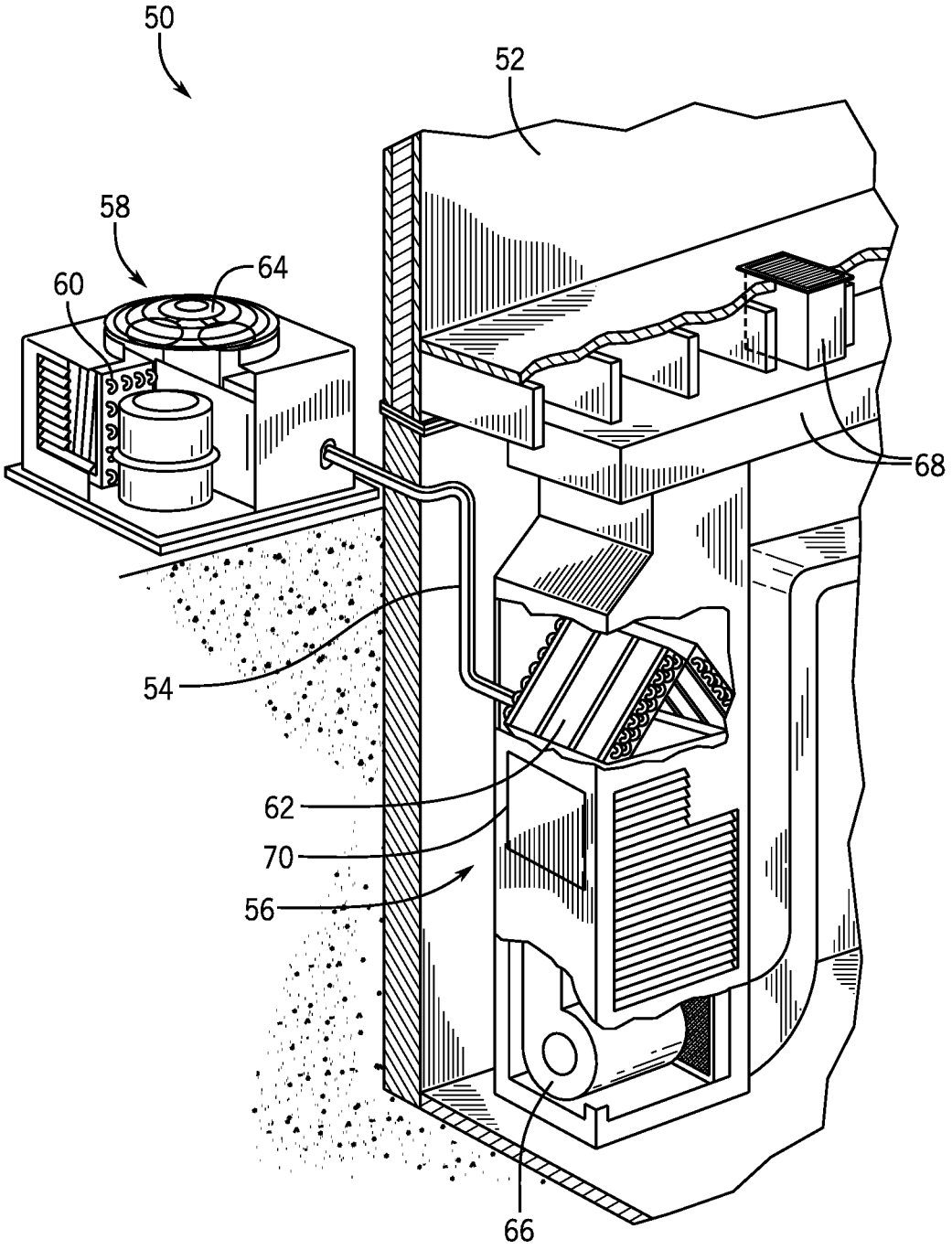
FIG. 3 is a perspective view of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The above-described shroud of outdoor unit 58 may include a mesh structure, or other air intake, that forms an air flow path between an interior and exterior of the shroud. The outdoor unit 58 draws environmental air into the shroud, via the air intake, and through the heat exchanger 60 using a fan 64, and expels the air above the outdoor unit 58. The fan 64 may be protected by a fan guard similar to, or different than, the above-described air intake of the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
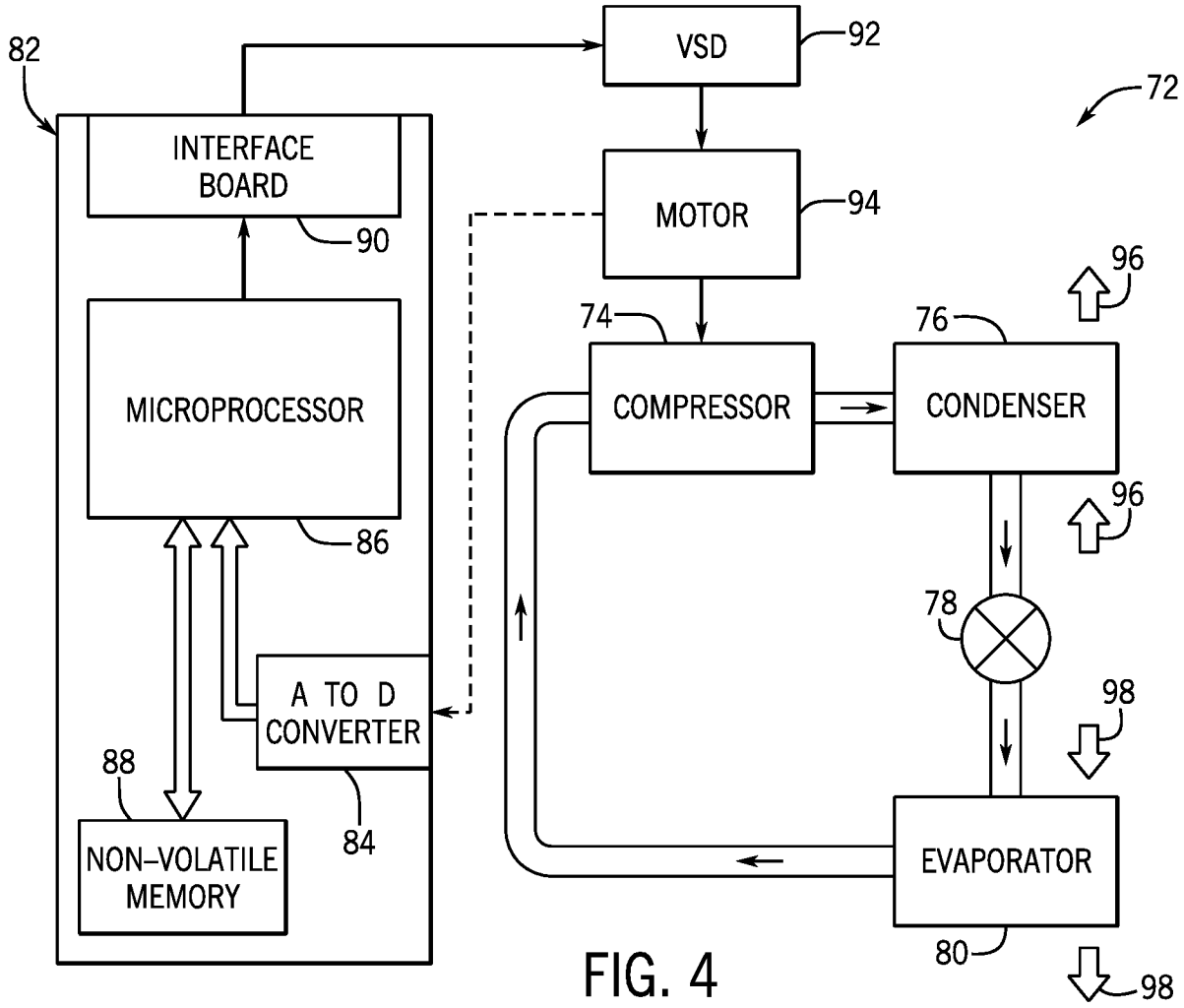
FIG. 4 is a schematic diagram of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

In each of FIGS. 1-4, the disclosed HVAC systems may include one or more air flow interfaces between an interior of a cabinet of the HVAC system and an external environment. For example, the HVAC system may include a hood, a louver, a fan orifice, a wall of a condenser section, a wall of a chiller, or some other air flow interface. In accordance with the present disclosure, the cabinet in any of FIGS. 1-4 may include a plastic guard disposed over any such air flow interface. The plastic guard may include an integrally formed plastic securement mechanism configured to engage the cabinet to retain the plastic guard on or in the cabinet. For example, the plastic securement mechanism may be an extension of the plastic guard. A cabinet opening may be formed in the cabinet and configured to receive the plastic securement mechanism. In some embodiments, the plastic securement mechanism may include a flexible material and certain geometry that, in conjunction with one another, enable the plastic securement mechanism to pass through the cabinet opening, and disable removal of the plastic securement mechanism from the cabinet opening after passing therethrough. It should also be noted that the plastic guard and integrally formed plastic securement mechanism may be retrofit for existing HVAC systems. In general, the plastic guard may be less expensive than traditional metallic embodiments, may include fewer parts than traditional metallic embodiments, does not require expensive anti-corrosive coating, is not susceptible to corrosion, and does not require expensive and timely assembly or installation techniques associated with traditional metallic embodiments.

Figure 5:
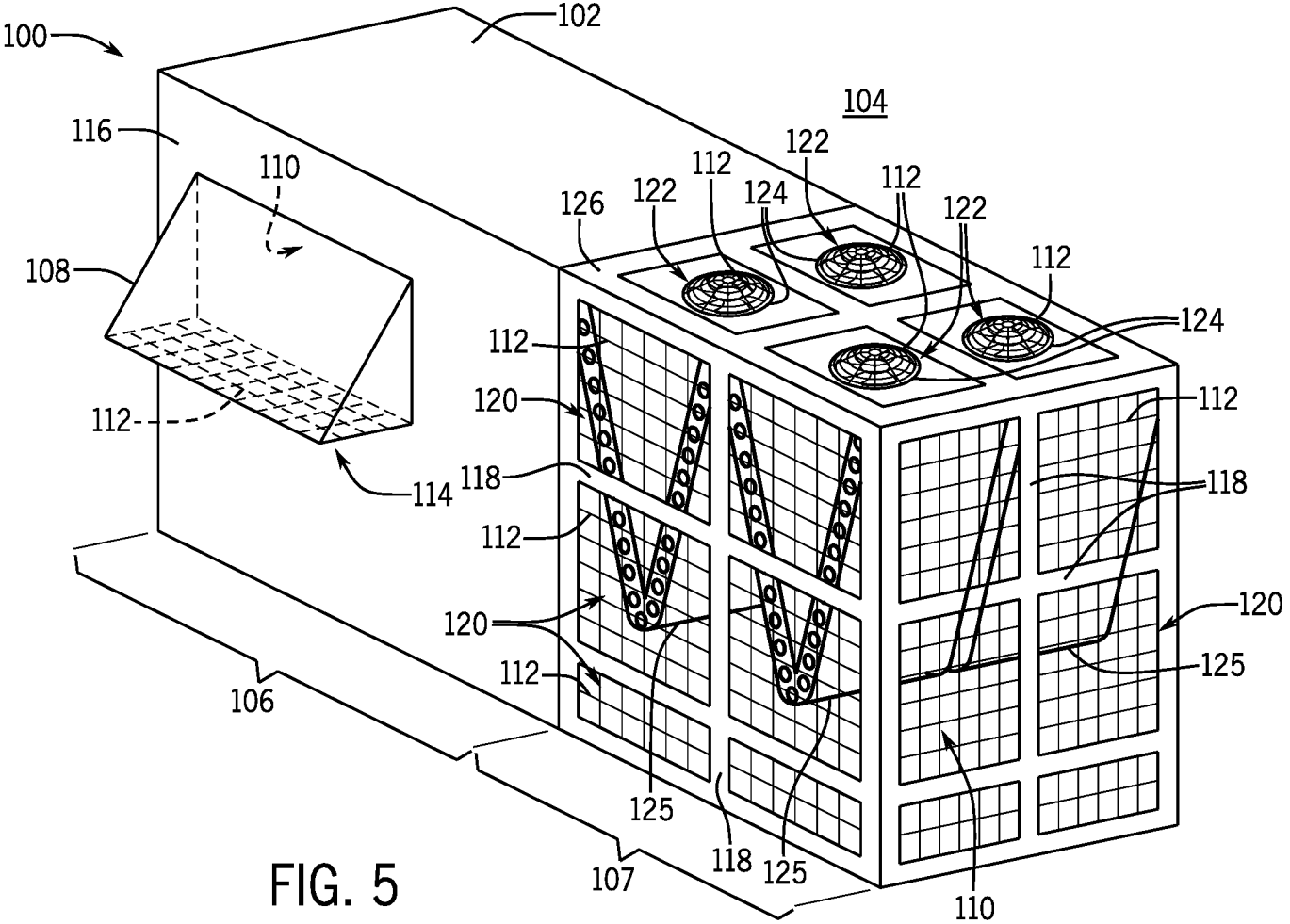
FIG. 5 is a perspective view of a rooftop unit (RTU) of the HVAC system of FIG. 1, including a cabinet having plastic guards protecting air flow interfaces between an external environment and an interior of the cabinet, in accordance with an aspect of the present disclosure.

With the foregoing in mind, FIG. 5 is a perspective view of an embodiment of a rooftop unit (RTU) 100 of the HVAC system of FIG. 1. The illustrated RTU 100 includes a cabinet 102 and plastic guards 112 that protect various air flow interfaces between an external environment 104 and an interior 110 of the cabinet 102. The air flow interfaces may be included in the cabinet 102 at both evaporator and condenser sections 106, 107 of the RTU 100, in accordance with the description below.

The evaporator section 106 of the RTU 100 may include a hood 108 through which an air flow is drawn. For example, a fan or blower (not shown) disposed in an interior 110 of the cabinet 102 may cause an air flow from the external environment 104, through an opening 114 in the hood 108, and into the interior 110 of the cabinet 102. The air flow may then pass over an evaporator (not shown) through which a refrigerant passes, to exchange heat with the refrigerant. As shown, one of the plastic guards 112 may be disposed over the opening 114 in the hood 108. Accordingly, the opening 114 in the hood 108 may be referred to as an "air flow interface" between the external environment 104 and the interior 110 of the cabinet 102, and the plastic guard 112 may be disposed over the air flow interface. It should be noted that the plastic guard 112 covering the opening 114 may be disposed anywhere within the hood 108, and may be oriented differently than the illustrated embodiment.

The illustrated RTU 100 includes other air flow interfaces protected by plastic guards 112. For example, the cabinet 102 of the RTU 100 may include, at the condenser section 107, frame members 118 that are joined to define windows 120 through the cabinet 102. The condenser section 107 of the RTU 100 may include fans 122 configured to draw an air flow from the external environment 104, through the windows 120, and into the interior 110 of the cabinet 102 at the evaporator section 107. The air flow may then pass over condenser coils 125 having refrigerant routed through the condenser coils 125, to exchange heat with the refrigerant. The fans 122 may also dispel the air flow from the cabinet interior 110, through fan orifices 124 corresponding to the fans 122 and disposed in a wall 126 of the RTU 100, and into the external environment 104. Thus, the windows 120 through which the air flow passes from the external environment 104 to the interior 110, and the fan orifices 124 through which the air flow passes from the interior 110 to the external environment 104, may be referred to as air flow interfaces. As shown, the plastic guards 112 may be disposed over the windows 120 and over the fan orifices 124. The plastic guards 112, which are disposed over the opening 114 in the hood 108, over the windows 120, and over the fan orifices 124 (collectively referred to as air flow interfaces), may be utilized to block contaminants and other articles from entering the interior 110 of the cabinet 102. The plastic guards 112 may be less expensive than traditional metallic embodiments, may include fewer parts than traditional metallic embodiments, may not require expensive anti-corrosive coating, may not be susceptible to corrosion, and may not require expensive and timely assembly or installation techniques associated with traditional metallic embodiments.

Figure 6:
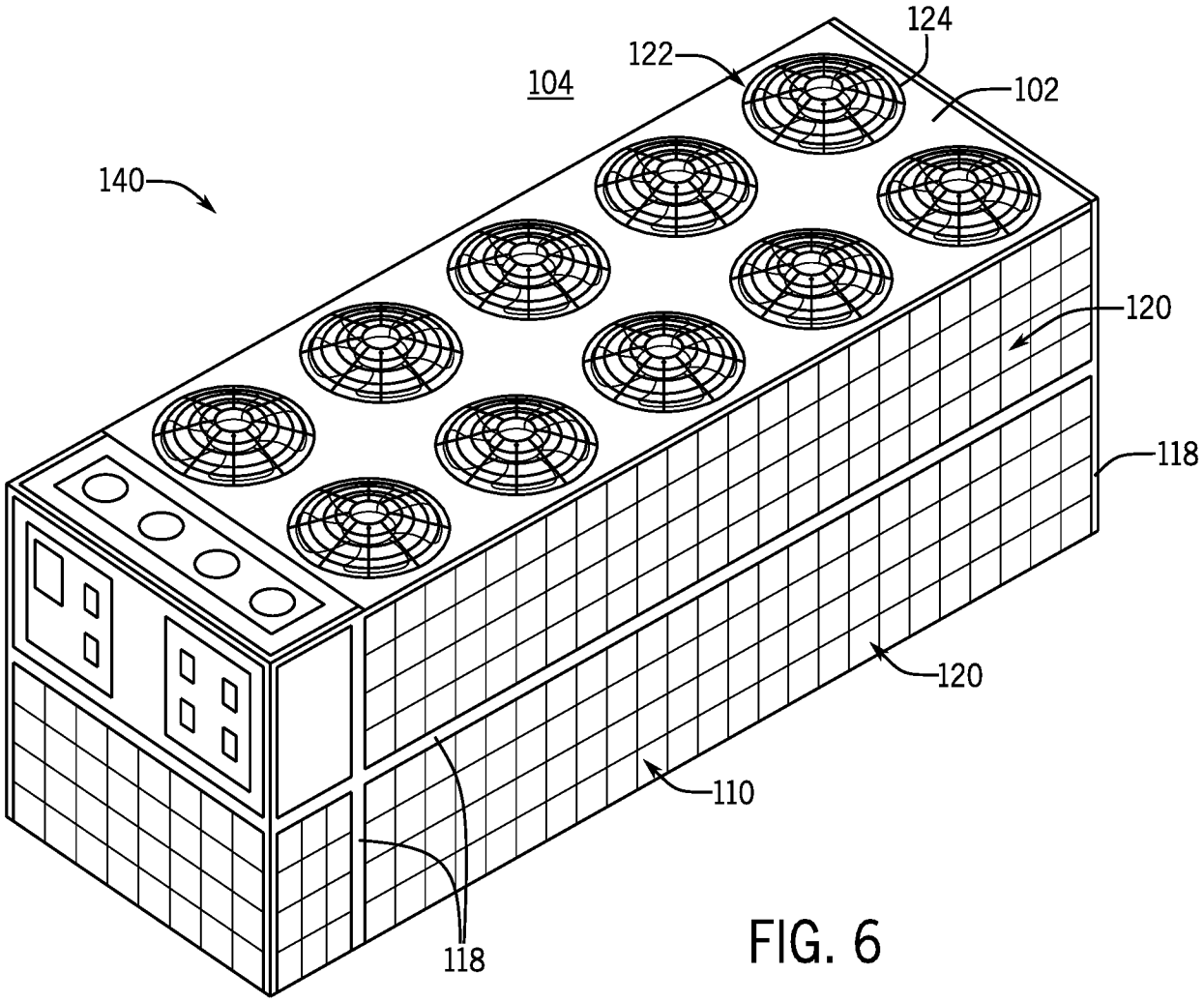
FIG. 6 is a perspective view of a chiller having a cabinet, and having plastic guards protecting air flow interfaces between an external environment and an interior of the cabinet, in accordance with an aspect of the present disclosure.

FIG. 6 is a perspective view of an embodiment of a chiller 140 having a cabinet 102 formed primarily by frame members 118, similar to the cabinet 102 at the condenser section 107 of the RTU 100 of FIG. 5. The chiller 140 also includes plastic guards 112 protecting air flow interfaces between the external environment 104 and the interior 110 of the cabinet 102 of the chiller 140. For example, similar to the condenser section 107 of the RTU 100 of FIG. 5, the chiller 140 of FIG. 6 includes fans 122 configured to draw an air flow from the external environment 104, through windows 120 formed in the cabinet 102, and into the interior 110 of the cabinet 102. The air flow may then pass over water coils disposed in the interior 110 of the cabinet 102, such that the water and air flow exchange heat. The air flow may then be passed from the interior 110, through the fan orifices 124 corresponding to the fans 122, and into the external environment 104. Thus, like the windows 120 and the fan orifices 124 at the condenser section 107 of the RTU 100 illustrated in FIG. 5, the windows 120 and the fan orifices 124 of the chiller 140 in FIG. 6 may be referred to as air flow interfaces. The plastic guards 112 in the chiller 140 of FIG. 6, like the plastic guards 112 illustrated in FIG. 5 and described above, may be less expensive than traditional metallic embodiments, may include fewer parts than traditional metallic embodiments, may not require expensive anti-corrosive coating, may not be susceptible to corrosion, and may not require expensive and timely assembly or installation techniques associated with traditional metallic embodiments.

Figure 7:
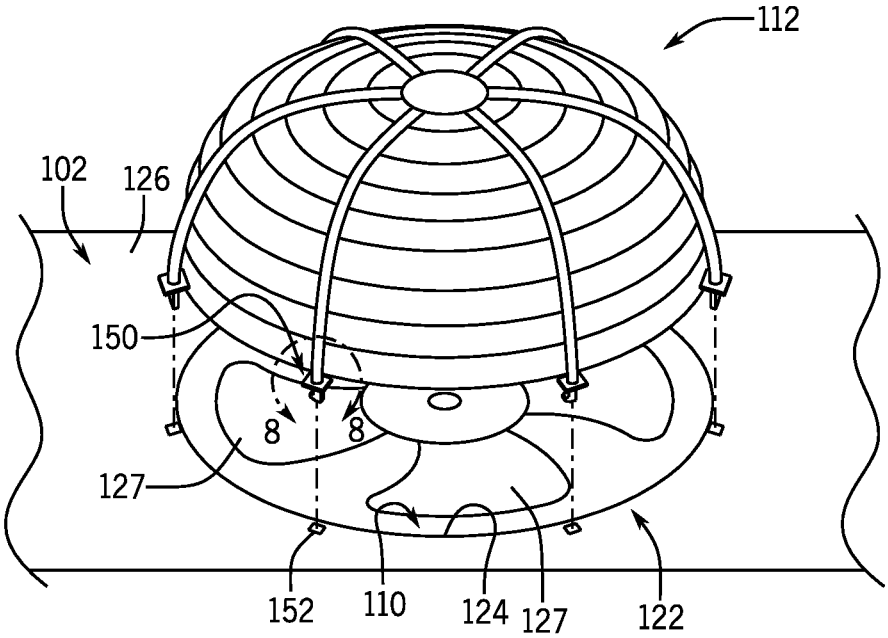
FIG. 7 is an exploded perspective view of a cabinet of any of the HVAC systems of FIGS. 1-6, a fan mounted in or on the cabinet, and a plastic guard having an integrally formed plastic securement mechanism configured to secure the plastic guard to the cabinet, in accordance with an aspect of the present disclosure.

FIG. 7 is an exploded perspective view of an embodiment of the cabinet 102 of any of the HVAC systems of FIGS. 1-6, the fan 122 mounted in or on the cabinet 102, and the plastic guard 112 having an integrally formed plastic securement mechanism 150 configured to secure the plastic guard 112 to the cabinet 102. For example, the illustrated embodiment may correspond to the RTU 100 of FIG. 5, the chiller 140 of FIG. 6, or any of the other preceding HVAC systems in FIGS. 1-4.

In the illustrated embodiment, the plastic guard 112 is formed entirely of plastic, and is formed by single-piece construction, including the integrally formed plastic securement mechanism 150. For example, the plastic guard 112 may be formed by a plurality of plastic wires, and may include the integrally formed plastic securement mechanism 150 extending from at least one of the plastic wires. That is, the integrally formed plastic securement mechanism 150 is an integrally formed component of the plastic guard 112, is not separately produced from the plastic guard 112, and is not separately secured to the plastic guard 112. The plastic guard 112, having the integrally formed plastic securement mechanism 150, may be produced via injection molding, rotational molding, extrusion molding, injection blow molding, reaction injection molding, vacuum casting, thermoforming, compression molding, or any other suitable plastic formation technique, or any combination thereof.

The cabinet 102 may include the illustrated wall 126 in which the fan orifice 124, which may house blades 127 of the fan 122, is disposed. Further, a cabinet opening 152 configured to receive the integrally formed plastic securement mechanism 150 of the plastic guard 112 may be disposed through the wall 126 of the cabinet 102. In accordance with the present disclosure, the integrally formed plastic securement mechanism 150 may be inserted through the cabinet opening 152 formed in the wall 126 of the cabinet 102, which may secure the plastic guard 112 to the cabinet 102. In some embodiments, the integrally formed plastic securement mechanism 150 may engage an underside of the wall 126 of the cabinet 102, or in other words a surface of the wall 126 facing the interior 110 of the cabinet 102. As shown, the plastic guard 112 may have several integrally formed plastic securement mechanisms 150, and the cabinet 102 may include several corresponding cabinet openings 152 configured to receive the several integrally formed plastic securement mechanisms 150. Each integrally formed plastic securement mechanism 150 is configured to engage the corresponding cabinet opening 152 to secure the plastic guard 112 to the cabinet 102 without using welding, adhesives, separate fasteners, or other types of expensive and/or complicated securement techniques. Because the cabinet 102 merely includes the cabinet openings 152 to receive the secure the plastic guard 112 to the cabinet 102, the plastic guard 112 may be retrofit to existing HVAC systems. For example, holes may be punched or otherwise disposed in the existing cabinet 102 for receiving the illustrated integrally formed plastic securement mechanisms 150 of the plastic guard 112.

FIG. 7 includes an externally mounted plastic guard 112 for the illustrated fan 122, where the plastic guard 112 includes curvature protruding outwardly from the cabinet 102. However, it should be appreciated that versions of the plastic guard 112 may protect other air flow interfaces of an HVAC system, and/or may not include the curvature illustrated in FIG. 7. In certain embodiments, the plastic guard 112 may include a generally flat plastic mesh structure similar to those illustrated in FIGS. 5 and 6, as opposed to the curved plastic mesh structure in FIG. 7, with the integrally formed plastic securement mechanism 150 extending therefrom. For example, the plastic guards 112 in FIGS. 5 and 6 covering the windows 120 formed between the frame members 118 of the cabinets 102 may include a generally flat plastic mesh structure. Additional aspects of the plastic guard 112 and the integrally formed plastic securement mechanism 150 are described in detail below.

Figure 8:
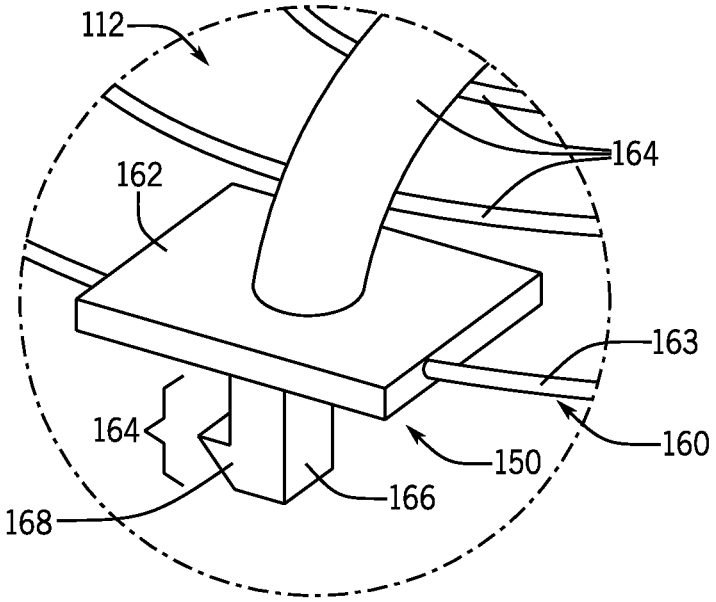
FIG. 8 is a perspective view of a portion of the plastic guard and the integrally formed plastic securement mechanism of FIG. 7, taken along line 8-8 in FIG. 7, in accordance with an aspect of the present disclosure.

FIG. 8 is a perspective view of an embodiment of a portion of the plastic guard 112 and the integrally formed plastic securement mechanism 150 of FIG. 7, taken along line 8-8 in FIG. 7. In the illustrated embodiment, the integrally formed plastic securement mechanism 150 is disposed along an outer edge 160 of the plastic guard 112, although the integrally formed plastic securement mechanism 150 may be formed in another area of the plastic guard 112 in other embodiments. The integrally formed plastic securement mechanism 150 may include a base 162 extending from a plastic wire 163 forming part of the plastic mesh structure of the plastic guard 112. Further, the integrally formed plastic securement mechanism 150 may include a retention mechanism 164 extending from the base 162. The retention mechanism 164 may include an extension 166 and a hook 168, where the extension 166 may be a generally rectangular prism and the hook 168 may be a generally triangular prism extending from the generally rectangular prism of the extension 166. The extension 166 may be configured to be disposed within, or reside in, the cabinet opening 152 illustrated in FIG. 7, and the hook 168 may be configured to engage the wall 126 of the cabinet 102 in FIG. 7, in which the cabinet opening 152 is formed. Thus, the hook 168 may contact an underside of the wall 126 to block removal of the integrally formed plastic securement mechanism 150, after the integrally formed plastic securement mechanism 150 is disposed through the cabinet opening 152 illustrated in FIG. 7. The hook 168 in FIG. 8 may be flexed or angled, so as to reduce a cross-sectional width of the integrally formed plastic securement mechanism 150 relative to the cabinet opening 152, during insertion of the plastic securement mechanism 150 through the cabinet opening 152. These and other features will be described in more detail below, with reference to FIGS. 9-13.

Figure 9:
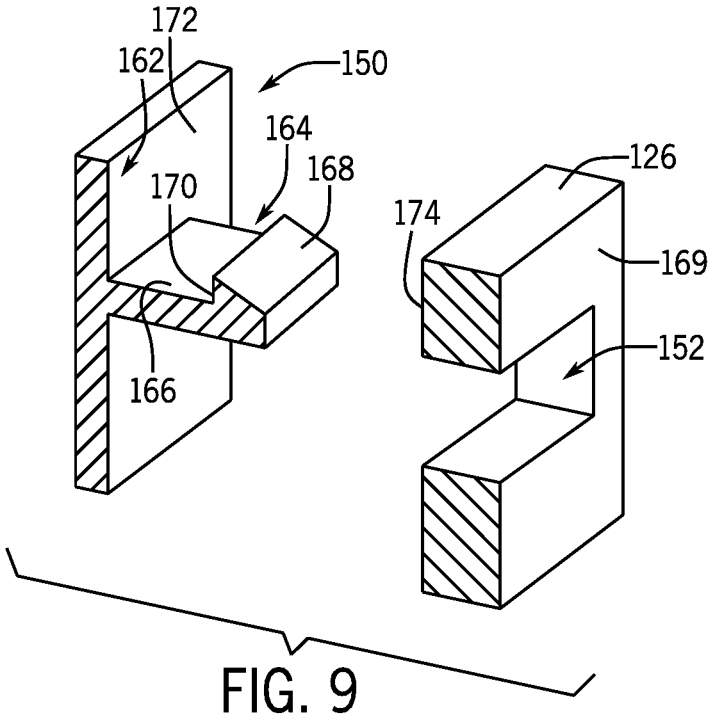
FIG. 9 is a schematic cross-sectional perspective view of an integrally formed plastic securement mechanism for use with any of the plastic guards of FIGS. 5-7, and a cabinet opening configured to receive the integrally formed plastic securement mechanism, in accordance with an aspect of the present disclosure.

FIG. 9 is a schematic cross-sectional perspective view of an embodiment of the integrally formed plastic securement mechanism 150 for use with any of the plastic guards of FIGS. 5-7, and the cabinet opening 152 configured to receive the integrally formed plastic securement mechanism 150. Because of the cross-section through the wall 126 having the cabinet opening 152, a portion of the wall 126 constraining the opening 152 is not shown.

As previously described, the retention mechanism 164 of the integrally formed plastic securement mechanism 150 may extend from the base 162 of the integrally formed plastic securement mechanism 150. The retention mechanism 164 may include the extension 166, such as a rectangular prism, extending directly from the base 162, and the hook 168, such as a triangular prism, extending from the extension 166. The extension 166 may be configured to reside within the cabinet opening 152 in the wall 126, and the hook 168 may be configured to contact a side 169, such as an inner side, of the wall 126, to retain engagement between the integrally formed plastic securement mechanism 150 and the wall 126 or the cabinet opening 152 therein. For example, the hook 168 may include a hook surface 170 configured to contact the side 169 of the wall 126 to block removal of the retention mechanism 164 from the cabinet opening 152 after the retention mechanism 164 is inserted through the cabinet opening 152.

As shown, the hook surface 170 may extend at a right angle relative to surfaces of the extension 166 of the retention mechanism 164. In another embodiment, the hook surface 170 may extend at an oblique angle relative to surfaces of the extension of the retention mechanism 165. When the retention mechanism 164 is disposed through the cabinet opening 152, a surface 172 of the base 162 of the integrally formed plastic securement mechanism 150 may contact, or be disposed adjacent to, a side 174, such as an outer side, of the wall 126. In this way, the wall 126 may be at least partially sandwiched between the surface 172 of the base 162 and the hook surface 170 of the hook 168 of the retention mechanism 164.

In some embodiments, the integrally formed plastic securement mechanism 150 may be flexible to enable passage of the hook 168 through the cabinet opening 152. For example, the hook 168 may flex downwardly as the retention mechanism 164 is inserted through the cabinet opening 152. Additionally or alternatively, the plastic securement mechanism 150 may be angled during insertion of the retention mechanism 164 through the cabinet opening 152, to reduce a cross-sectional width or area of the retention mechanism 164, during the insertion process, relative to a cross-sectional width or area of the cabinet opening 152.

Figure 10:
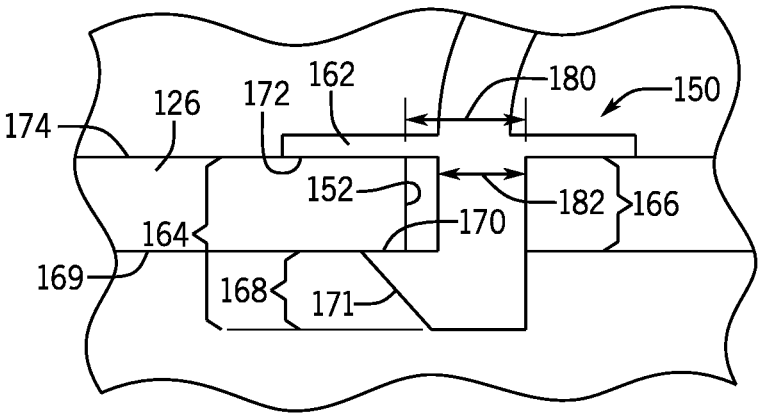
FIG. 10 is a cross-sectional side view of the integrally formed plastic securement mechanism of FIG. 9 disposed in the cabinet opening, in accordance with an aspect of the present disclosure.

FIG. 10 is a cross-sectional side view of an embodiment of the integrally formed plastic securement mechanism 150 of FIG. 9 disposed in the cabinet opening 152. As shown, a cross-sectional width 182 of the extension 166 of the retention mechanism 164 may be smaller than a cross-sectional width 180 of the cabinet opening 152, which may enable passage of the retention mechanisms 164 through the cabinet opening 152 via flexing and/or angling of the retention mechanism 164 during insertion. A sloped surface 171 of the hook 168 of the retention mechanism 164 may also facilitate insertion of the retention mechanism 164 into the cabinet opening 152. As previously described, the hook 168 may extend from the extension 166 and may include the hook surface 170 extending at a right angle from the extension 166. In other embodiments, the hook surface 170 may extend at an oblique angle from the extension 166. The hook surface 170 may contact the side 169 of the wall 126, and the base surface 172 of the base 162 of the integrally formed plastic securement mechanism 150 may engage the opposing side 174 of the wall 126. Accordingly, the wall 126 may be sandwiched between the hook surface 170 and the base surface 172. In other words, the wall 126 may be sandwiched between the base 162 of the integrally formed plastic securement mechanism 150 and the hook 168 of the retention mechanism 164 of the integrally formed plastic securement mechanism 150.

Figure 12:
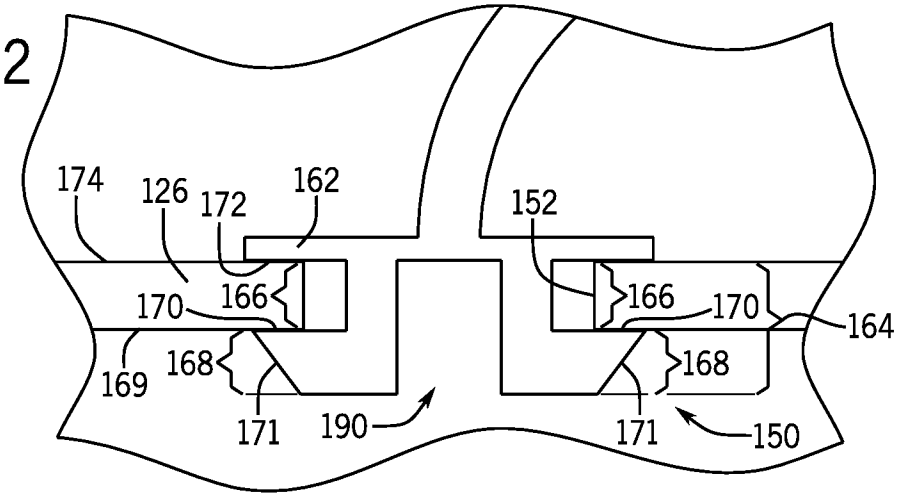
FIG. 12 is a cross-sectional side view of the integrally formed plastic securement mechanism of FIG. 11 disposed in the cabinet opening, in accordance with an aspect of the present disclosure.
Figure 13:
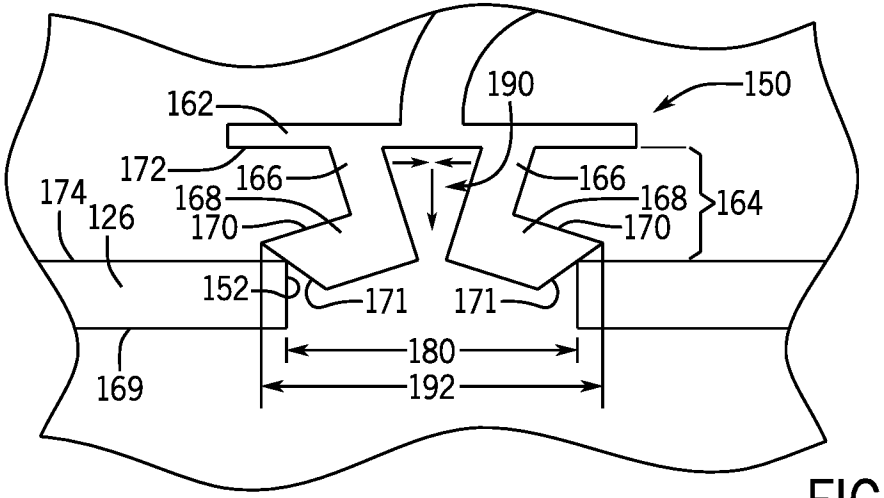
FIG. 13 is a side view of the integrally formed plastic securement mechanism of FIG. 11 in the process of being disposed through the cabinet opening, in accordance with an aspect of the present disclosure.
Figure 11:
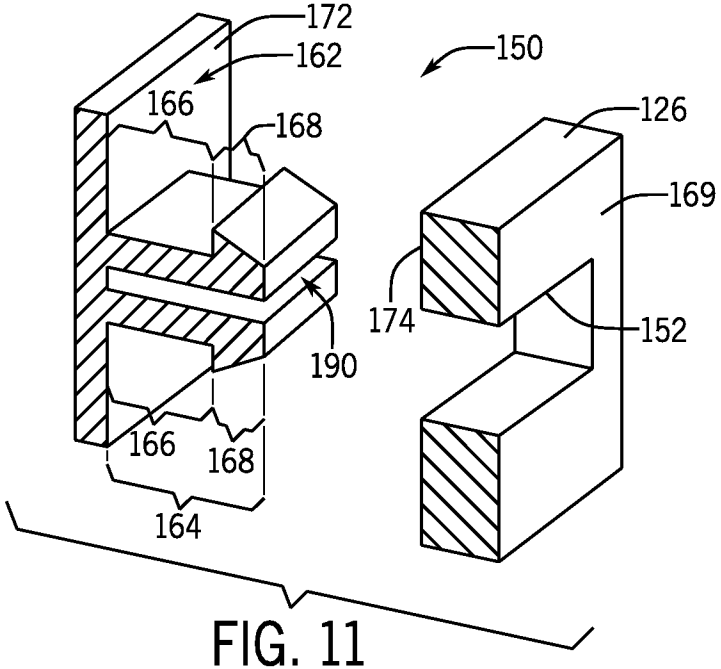
FIG. 11 is a schematic cross-sectional perspective view of another integrally formed plastic securement mechanism for use with any of the plastic guards of FIGS. 5-7, and a cabinet opening configured to receive the integrally formed plastic securement mechanism, in accordance with an aspect of the present disclosure.

FIGS. 11-13 illustrate various views of another embodiment of the integrally formed plastic securement mechanism 150 engaging the cabinet opening 152 formed in the wall 126 of the cabinet. For example, FIG. 11 is a schematic cross-sectional perspective view of the integrally formed plastic securement mechanism 150 for use with any of the plastic guards of FIGS. 5-7, and the cabinet opening 152 configured to receive the integrally formed plastic securement mechanism 150. FIG. 12 is a cross-sectional side view of the integrally formed plastic securement mechanism 150 of FIG. 11 disposed in the cabinet opening 152. FIG. 13 is a cross-sectional side view of the integrally formed plastic securement mechanism 150 of FIG. 11 in the process of being disposed through the cabinet opening 152.

In FIGS. 11-13, the integrally formed plastic securement mechanism 150 includes the base 162 and the retention mechanism 164. The retention 164 mechanism includes two instances of the extension 166 and two instances of the hook 168, where the hooks 168 face opposing directions and a gap 190 is disposed between the pairs of extension 166 and hook 168. As illustrated in FIGS. 12 and 13 in particular, the gap 190 may enable the retention mechanism 164, or in other words each pair of extension 166 and hook 168, to flex inwardly into the gap 190, which may enable passage of the retention mechanism 164 of the integrally formed plastic securement mechanism 150 through the cabinet opening 152. For example, the cabinet opening 152 may include the cross-sectional width 180 illustrated in FIG. 13, and the retention mechanism 164 may include a total cross-sectional width 192 that is reducible by pinching the pairs of extension 166 and hook 168 inwardly into the gap 190.

The retention mechanism 164 may be cantilevered from the base 162 of the integrally formed plastic securement mechanism 150 to facilitate the above-described reduction in the total cross-sectional width 192. Further, the sloped surfaces 171 of the hooks 168 and other illustrated geometric features may facilitate the reduction in the total cross-sectional width 192. For example, the sloped surfaces 171 of the hooks 168 may contact the wall 126, causing the above-described reduction in the total cross-sectional width 192 of the retention mechanism 164 during insertion through the cabinet opening 152. As suggested above, the extensions 166 may be cantilevered from the base 162 at an angle that, in conjunction with the above-described sloped surfaces 171, enables the reduction in the total cross-sectional width 192 of the retention mechanism 164 during insertion through the cabinet opening 152. After insertion through the cabinet opening 152, the pairs of hooks 168 and extensions 166 may flex outwardly as shown in FIG. 12. The hook surfaces 170 of the hooks 168 may then engage the side 169 of the wall 126, thereby blocking removal of the retention mechanism 164 from the cabinet opening 152.

Technical benefits of the disclosed embodiments include reduced cost of guarding or protecting air flow interfaces for cabinets of various HVAC systems, and fewer parts than traditional metallic embodiments. Further, disclosed embodiments do not require expensive anti-corrosive coating, are not susceptible to corrosion, and do not require expensive and timely assembly or installation techniques associated with traditional metallic embodiments.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An outdoor unit of a heating, ventilation, and/or air conditioning (HVAC) system, comprising:

a cabinet defining a cabinet interior of the outdoor unit and separating the cabinet interior from an external environment surrounding the outdoor unit;

an interface between the cabinet interior and the external environment, wherein the interface is configured to enable an air flow between the cabinet interior and the external environment, and wherein the cabinet comprises an opening adjacent to the interface; and a plastic guard disposed over the interface and comprising a plastic securement mechanism extending through the opening to secure the plastic guard to the cabinet, wherein the plastic securement mechanism comprises a retention mechanism configured to block removal of the plastic securement mechanism from the opening, the retention mechanism comprises an extension disposed within the opening and a hook extending from the extension, wherein the hook is disposed external to the opening, wherein the plastic guard comprises a plastic wire guard, and wherein the plastic securement mechanism extends from one or more plastic wires of the plastic wire guard.

2. The outdoor unit of claim 1, wherein the plastic securement mechanism is integrally formed with the plastic guard.

3. The outdoor unit of claim 1, comprising a fan disposed between the plastic guard and an opposing interior wall of the cabinet, wherein the fan is configured to cause the air flow between the cabinet interior and the external environment.

4. The outdoor unit of claim 1, comprising a heat exchanger disposed within the cabinet interior and configured to receive the air flow.

5. The outdoor unit of claim 1, wherein the interface is formed by a hood or a louver.

6. The outdoor unit of claim 1, wherein the cabinet is a portion of a rooftop unit or a chiller.

7. The outdoor unit of claim 1, wherein the plastic securement mechanism includes a base extending from the extension, and wherein a portion of a wall of the cabinet in which the opening is disposed is sandwiched between the base of the plastic securement mechanism and the hook of the retention mechanism of the plastic securement mechanism.

8. The outdoor unit of claim 1, wherein a portion of the retention mechanism is configured to flex to enable insertion of the retention mechanism into the opening.

9. The outdoor unit of claim 1, wherein the cabinet includes a plurality of frame members, and the interface between the cabinet interior and the external environment is disposed between adjacent frame members of the plurality of frame members.

10. The outdoor unit of claim 1, wherein the hook extends from the extension at a right angle or an oblique angle.

11. The outdoor unit of claim 1, wherein the plastic securement mechanism is configured to engage an underside of a wall of the cabinet.

12. An outdoor unit of a heating, ventilation, and/or air conditioning (HVAC) system, comprising:

a cabinet defining a cabinet interior of the outdoor unit and separating the cabinet interior from an external environment surrounding the outdoor unit;

an air flow interface between the cabinet interior and the external environment, wherein the air flow interface is configured to enable an air flow between the external environment and the cabinet interior;

an opening in the cabinet adjacent to the air flow interface; and a plastic guard disposed over the air flow interface and configured to enable the air flow, wherein the plastic guard comprises a plastic wire guard, wherein the plastic guard includes an integrally formed plastic securement mechanism having a retention mechanism extending through the opening and blocking removal of the integrally formed plastic securement mechanism from the opening, wherein the retention mechanism comprises a first portion positioned within the opening and a second portion extending from the first portion and blocking removal of the integrally formed plastic securement mechanism from the opening, wherein the second portion is disposed external to the opening, and wherein the integrally formed plastic securement mechanism extends from one or more plastic wires of the plastic wire guard.

13. The outdoor unit of claim 12, wherein the second portion comprises a hook.

14. The outdoor unit of claim 12, wherein the integrally formed plastic securement mechanism comprises a base from which the retention mechanism extends.

15. The outdoor unit of claim 14, wherein the cabinet comprises a cabinet wall in which the opening is disposed, and wherein the cabinet wall is sandwiched between the base of the integrally formed plastic securement mechanism and the second portion of the retention mechanism of the integrally formed plastic securement mechanism.

16. The outdoor unit of claim 12, wherein the integrally formed plastic securement mechanism includes a flexible portion configured to flex to enable disposal of the integrally formed plastic securement mechanism through the opening.

17. The outdoor unit of claim 12, wherein the cabinet is a portion of a rooftop unit or a chiller.

18. The outdoor unit of claim 12, wherein the second portion extends transverse to the first portion.

* * * * *